United States Patent [19]

Haslund

[11] 4,386,578

[45] Jun. 7, 1983

[54] HIGH VELOCITY METALLIC MASS INCREMENT VACUUM DEPOSIT GUN

[75] Inventor: Ralph L. Haslund, Mercer Island, Wash.

[73] Assignee: The Boeing Company, Seattle, Wash.

[21] Appl. No.: 266,978

[22] Filed: May 26, 1981

[51] Int. Cl.[3] ..... C23C 13/12

[52] U.S. Cl. ..... 118/669; 118/682; 118/703; 118/723; 118/726; 118/729; 118/50.1; 427/47; 427/248.1; 427/50; 219/6.5; 219/121 EE

[58] Field of Search ..... 118/722, 723, 715, 726, 118/729, 730, 50.1, 703, 704, 669, 695, 620, 679, 118/682; 427/37, 50, 47, 248.1; 219/127, 76.1, 76.17, 219/6.5, 7.5, 121 EE, 271; 318/135

[56] References Cited

U.S. PATENT DOCUMENTS

| | | | |
|---|---|---|---|
| 2,976,174 | 3/1961 | Howard . | |
| 3,093,770 | 6/1963 | Wesley et al. . | |
| 3,142,587 | 7/1964 | Weber . | |
| 3,149,372 | 9/1964 | Stinger . | |
| 3,213,826 | 10/1965 | Lins et al. . | |
| 3,232,085 | 2/1966 | Inoue . | |
| 3,234,429 | 2/1966 | Schrom . | |
| 3,267,710 | 8/1966 | Inoue . | |
| 3,461,268 | 8/1969 | Inoue . | |
| 3,640,110 | 2/1972 | Inoue . | |
| 3,709,194 | 1/1973 | Hammelmann . | |
| 4,121,537 | 10/1978 | Maruyama et al. | 118/720 X |
| 4,124,244 | 11/1978 | Bryant . | |
| 4,125,391 | 11/1978 | Van Laethem . | |

OTHER PUBLICATIONS

"Repetitive Pulsed Acceleration of Plasmas Derived From Exploding Metal Films", *Exploding Wires*, vol. 3, Plenum Press, New York, 1964, by T. L. Rosebrock et al.

"Rail Type Pulsed Plasma Acceleration", EDR 3255, Allison Div. of General Motors, Apr. 1963 (AFOSR 5070); by T. L. Rosebrock et al.

"Propulsion Systems for Space Flight", McGraw-Hill Book Company, Inc., New York, 1960, by W. R. Corliss.

"Vaporization Waves in Metals", *Exploding Wires*, vol. 4, Plenum Press, New York, 1968, by F. D. Bennett et al.

"The Confined Parallel Rail Pulsed Plasma Accelerator", American Rocket Society Paper #2397-62, Mar. 1962, by M. E. Maes.

*Primary Examiner*—John D. Smith
*Assistant Examiner*—Bernard F. Plantz
*Attorney, Agent, or Firm*—Schwartz, Jeffery, Schwaab, Mack, Blumenthal & Koch

[57] ABSTRACT

A vacuum deposit device for use in producing thin film depositions. A metallic mass is accelerated along a pair of rail-type electrodes. The discharge current passing through the mass during acceleration is controlled as to magnitude and time duration to insure that the magnetic pinch pressure produced by the current exceeds the thermal expansion pressure of the mass thereby maintaining the mass in a solid, non-vapor state during acceleration. The device permits control over mass exit velocities and permits deposition areas of well defined shoulders.

28 Claims, 14 Drawing Figures

HIGH VELOCITY METALLIC MASS INCREMENT VACUUM DEPOSIT GUN

BACKGROUND OF THE INVENTION

The present invention generally relates to a method and apparatus for thin film deposition, and more particularly to the controlled deposition of thin films onto a predetermined area of a moving substrate.

Thin film deposition techniques of the prior art include explosively vaporizing an electrical conductor and causing the resulting vapor to condense in a vacuum or in a non-contaminating atmosphere onto a suitable substrate. In non-directed vapor deposition, mass motion is thermally initiated by the radial vapor dispersion accompanying the explosive vaporization of a wire conductor. In directed vapor deposition, vapor is directed towards a substrate by the interaction with electrostatic and electromagnetic fields providing that the vapor particles are charged or of a magnetic nature. In either instance, vapor formation is not suppressed during heating and the distribution in droplet size and temperature depends upon the uniform heating of the conductor.

The prior art is replete with charged particle accelerating devices wherein a current conducting substance, situated between a pair of current conducting rail electrodes, is accelerated by the force resulting from the interaction between the magnetic field between the rail electrodes and the moving charge particles in the conducting substance. Any conducting substance may be accelerated in a linear electric motor of this nature and it is well known to form a current conducting plasma between two rail electrodes by discharging a storage capacitor to explosively vaporize an electrical conductor. The common configuration of a plasma accelerator is such that a magnetic field is built up behind the plasma that is perpendicular to the current in the plasma so that the resultant mutually perpendicular force on the plasma accelerates it down the electrodes. Current discharge is commonly of an under-damped RLC type and is continuously applied to the rail electrodes with full current oscillation. In addition to rail-type plasma guns, Kolb tubes are known utilizing a backstrap electrode having current flow anti-parallel to the current flow in the plasma. Because the direction of force does not change, rail-type guns and Kolb tubes can be operated cyclically to accelerate a neutral plasma to relatively high speeds. Current flow is terminated when the plasma leaves the electrodes, acting as its own switch.

Both rail-type and Kolb tube plasma accelerators can be operationally efficient, but possess certain disadvantages when applied to thin film deposition techniques due to non-uniform mass acceleration. In such systems, when the electrical conductor is explosively vaporized, the heated material expands in all directions and is uncontained in the radial direction away from the wire axis. During initial current rise, the thermal pressure of the plasma exceeds the self-induced magnetic "pinch" pressure resulting from the passage of current through the plasma, and the metal wire propellants explode with a high radial velocity superposed on the directed velocity causing dispersion of the plasma with resultant broad velocity distribution. Further, the electrical resistivity of a plasma has a negative slope with increasing temperature, causing the plasma current to tend to collapse into an arc. Therefore, the plasma is driven toward non-uniform current conduction as it is heated during acceleration adding to non-uniform velocity and mass distributions. The large resultant non-uniformities make it difficult to deposit the vapor on a moving substrate without smearing. Rail inductance is maximized compared to the external discharge circuit inductance to reduce the duration of energy transfer and increase plasma acceleration efficiency; and as a result, the discharge circuit parameters, such as frequency, are continually changing and control over the current magnitude and time variation is difficult to achieve.

SUMMARY OF THE INVENTION

In accordance with the present invention, means are provided for clamping a metallic foil, having a predetermined thickness, between a pair of parallel rail electrodes to which a high power electrical supply is connected. A high current impulse applied to the foil and electrodes has a sufficient amplitude and duration to form a molten foil mass. By matching the discharge current magnitude and time variation to the foil thickness, a compressive magnetic "pinch" pressure is produced by the current flow through the foil. The pinch (compressive) pressure is greater than the vapor pressure of the magnetic foil. The pinch condition is preserved throughout the acceleration process to suppress vapor formation and assure uniform current conduction thereby providing uniform mass acceleration and mass which breaks up into uniform droplet size.

A further important feature of the invention is the provision of a discharge circuit provided with an inductance external to the rail electrode which is about two orders of magnitude larger than the maximum self-inductance of the rail electrodes which themselves have a geometrically maximized inductance per unit length. The large circuit inductance provides control over the discharge current magnitude and time variation to ensure that an adequate "pinch" condition is preserved throughout the entire acceleration process. Further, a current diverting circuit actuated at the end of the first half cycle of current discharge prevents current reversal as well as prevents arcing between the rail electrodes through the molten foil mass to the deposition surface.

In addition to the highly desirable feature of control over the discharge current magnitude and time variation, the invention is further characterized by matching the rail electrode length to the foil mass motion so that the discharge current flow is zero just as the mass reaches the end of the rails. Thus, the molten mass travels through the gun as a superheated solid and leaves the rail electrodes as a sharply defined, uniformly heated, high density, nearly uniform droplet, slug of spray. The mass is in droplet form rather than vapor form. The slug of spray expands explosively as it leaves the rail electrodes, but because of the uniformity of droplet size, the deposited layer has a well-defined shoulder in contrast to the smeared out layer which would result if there was a distribution in droplet sizes and temperatures.

Still another feature of the invention is provided by matching the spacing between the end of the rail electrodes and the surface on which the accelerated mass is to be deposited to the instantaneous state of the mass as it expands upon leaving the rail electrodes. A continuous range of deposition conditions are available from a predominantly small uniform droplet spray pulse of relatively narrow lateral dimension to a predominantly vapor pulse of large lateral dimension.

A further important feature and a significant advantage of the invention is the precise control over mass increment magnitude, thermal energy addition to the mass, and directed kinetic energy applied to the mass. In accordance with the present invention, the rail electrode spacing is dimensioned to cut out a foil area corresponding to the desired mass increment for a given initial foil thickness and composition. Since the mass magnitude is known, the discharge circuit elements and rail electrode length can be tuned to control both the degree of heating of the mass increment and its exit velocity. Therefore, the amount of thermal energy added to the mass increment may be varied to control the calorimetric interaction with the surface on which the mass is deposited.

Another significant advantage of the invention flows from the precise control over the exit velocity of the molten metal mass. Submicrosecond timing of the center of mass motion can be obtained through the use of standard electrical controls on the gun operation. By indexing the motion of a substrate surface with the triggering of the gun discharge, the center of mass of the thin film can be precisely located with excellent spatial accuracy.

Yet another object of the present invention is to combine the parallel rail electrode configuration with a backstrap electrode having current flow antiparallel to the current flow through the molten mass to provide an additional accelerating force. The backstrap or back transverse electrode may be symmetrically split about the initial foil position for structural convenience. The additional axial magnetic field component at each side of the foil which tends to focus the molten foil mass inwardly is too small by more than an order of magnitude to alter the primary acceleration process.

BRIEF DESCRIPTION OF THE DRAWINGS

These and other objects of the invention will be apparent in reference to the following description taken in conjunction with the drawings wherein.

Figure 4:
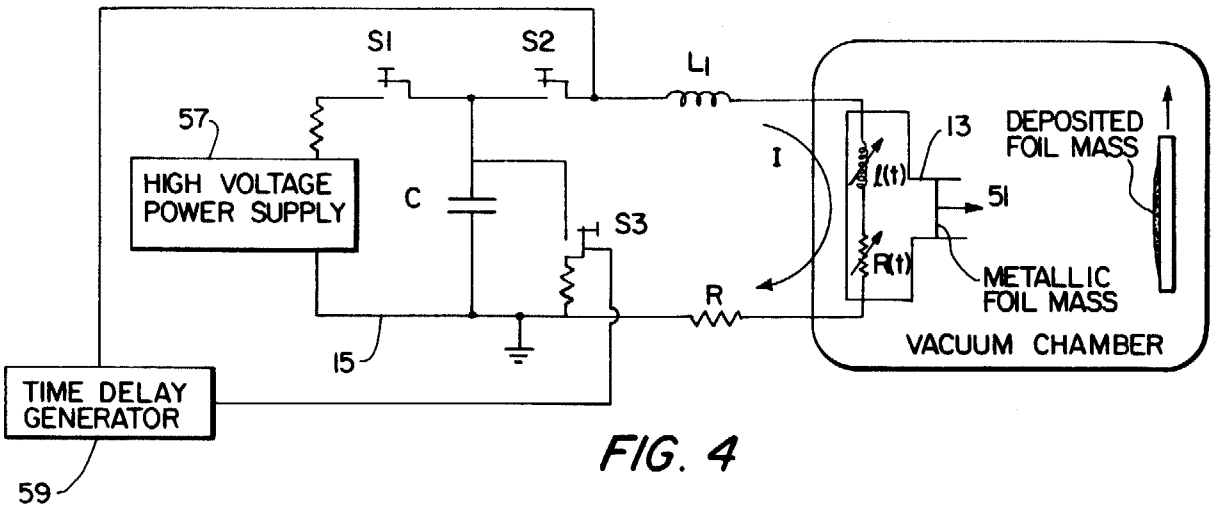
Figure 6:
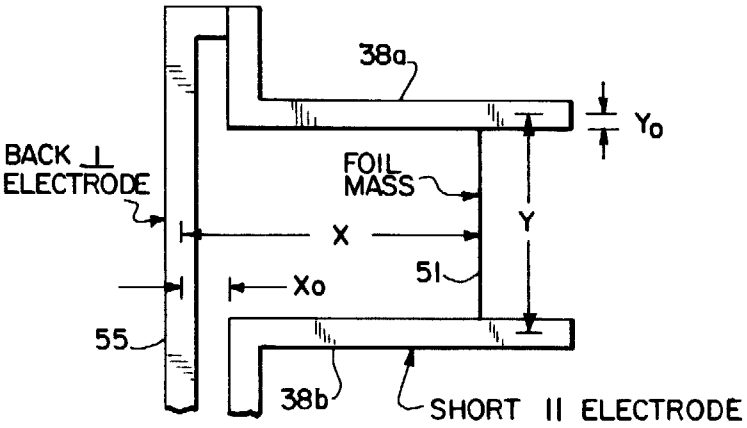
Figure 5:
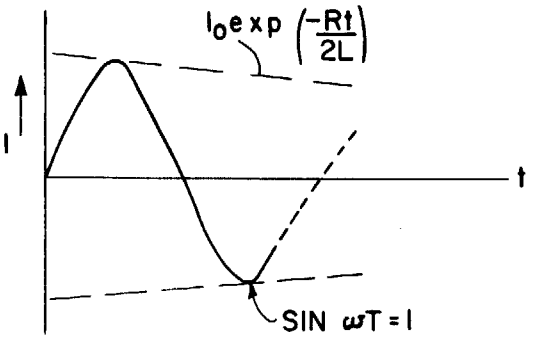
Figure 7:
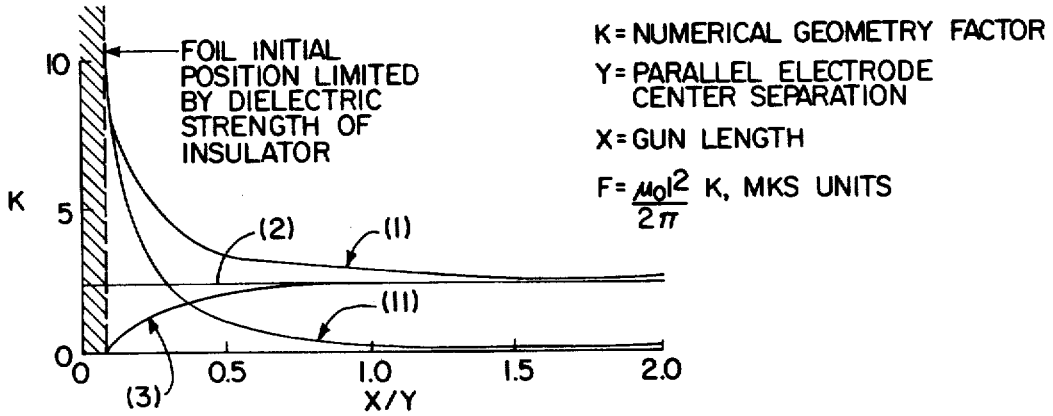
Figure 8:
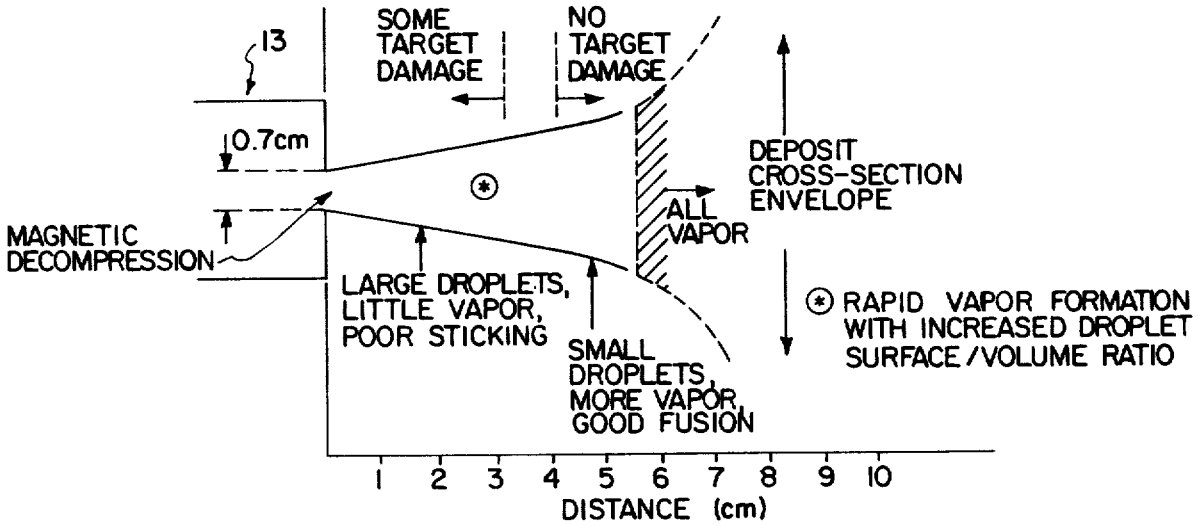
Figure 9:
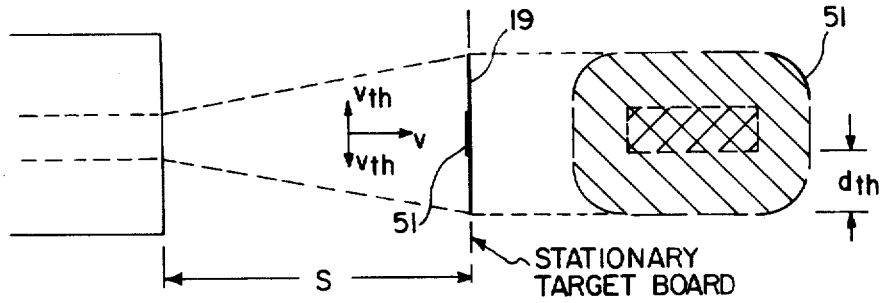
Figure 10:
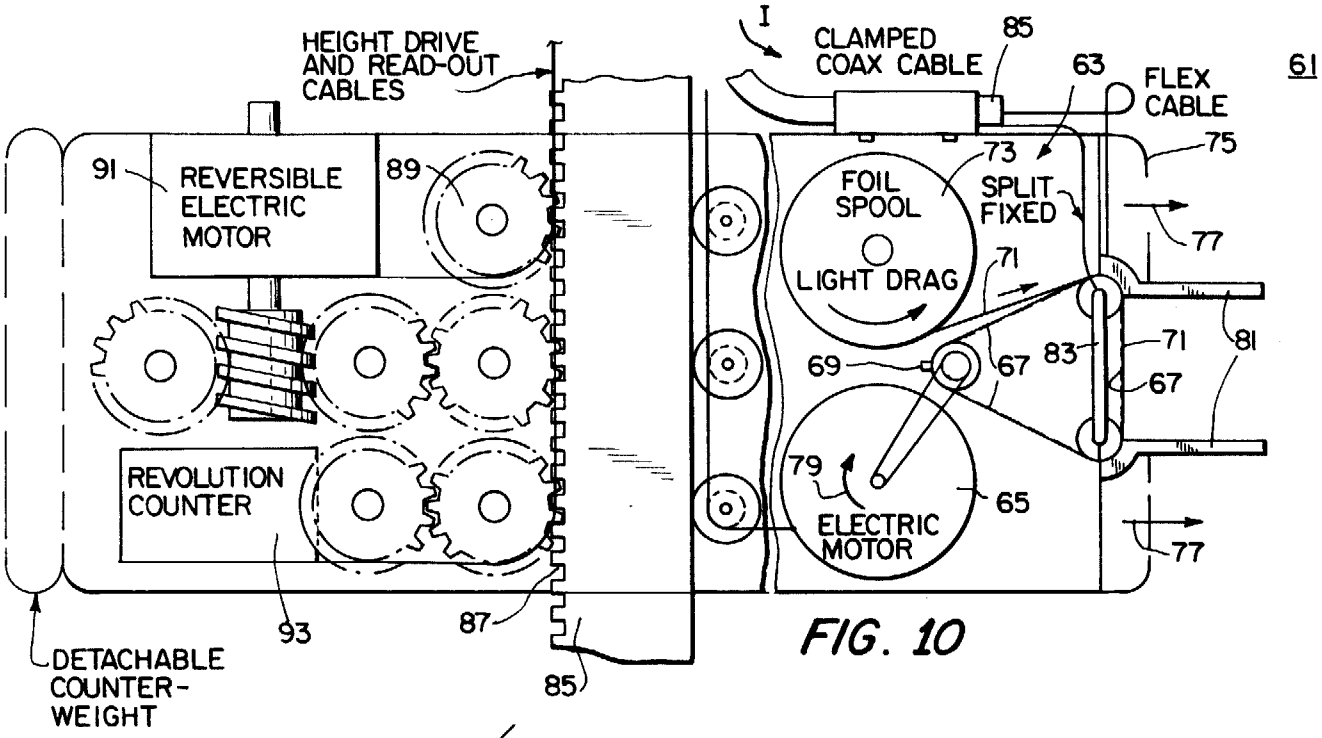
Figure 11:
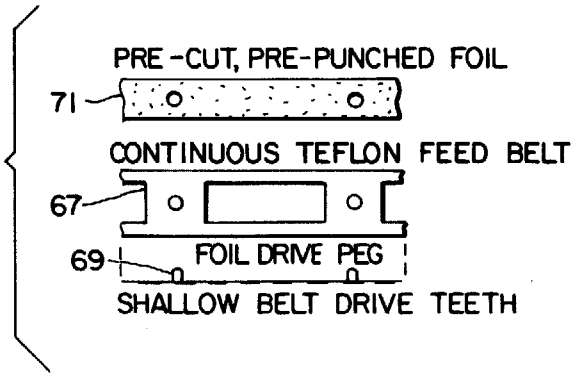

FIGS. *3a–3d* are fragmentary, perspective views illustrating different electrode configurations;

FIG. 4 is a schematic illustrating the discharge circuit elements of the present invention;

FIG. 5 is a chart illustrating the diagnostic discharge current amplitude with respect to time to demonstrate magnetic pinch;

FIG. 6 is an illustration showing the gun electrode using a backstrap electrode;

FIG. 7 is a graph showing the accelerating force gun inductance dependent proportionality factor as a function of rail dimensions and gun geometry;

FIG. 8 is a graph illustrating the amount of thermal expansion experienced by the molten metal foil with respect to the distance traveled by the molten metal foil;

FIG. 9 is a side schematic view illustrating the deposit characteristics of the molten metal foil;

FIG. 10 is a schematic diagram of another embodiment of the invention wherein the metal foil is in the form of a long strip stored on a spool for automatic feeding to a gun mechanism; and FIG. 11 illustrates the continuous drive belt and foil strip of the embodiment of FIG. 10.

DETAILED DESCRIPTION OF THE PREFERRED EMBODIMENT

Figure 1:
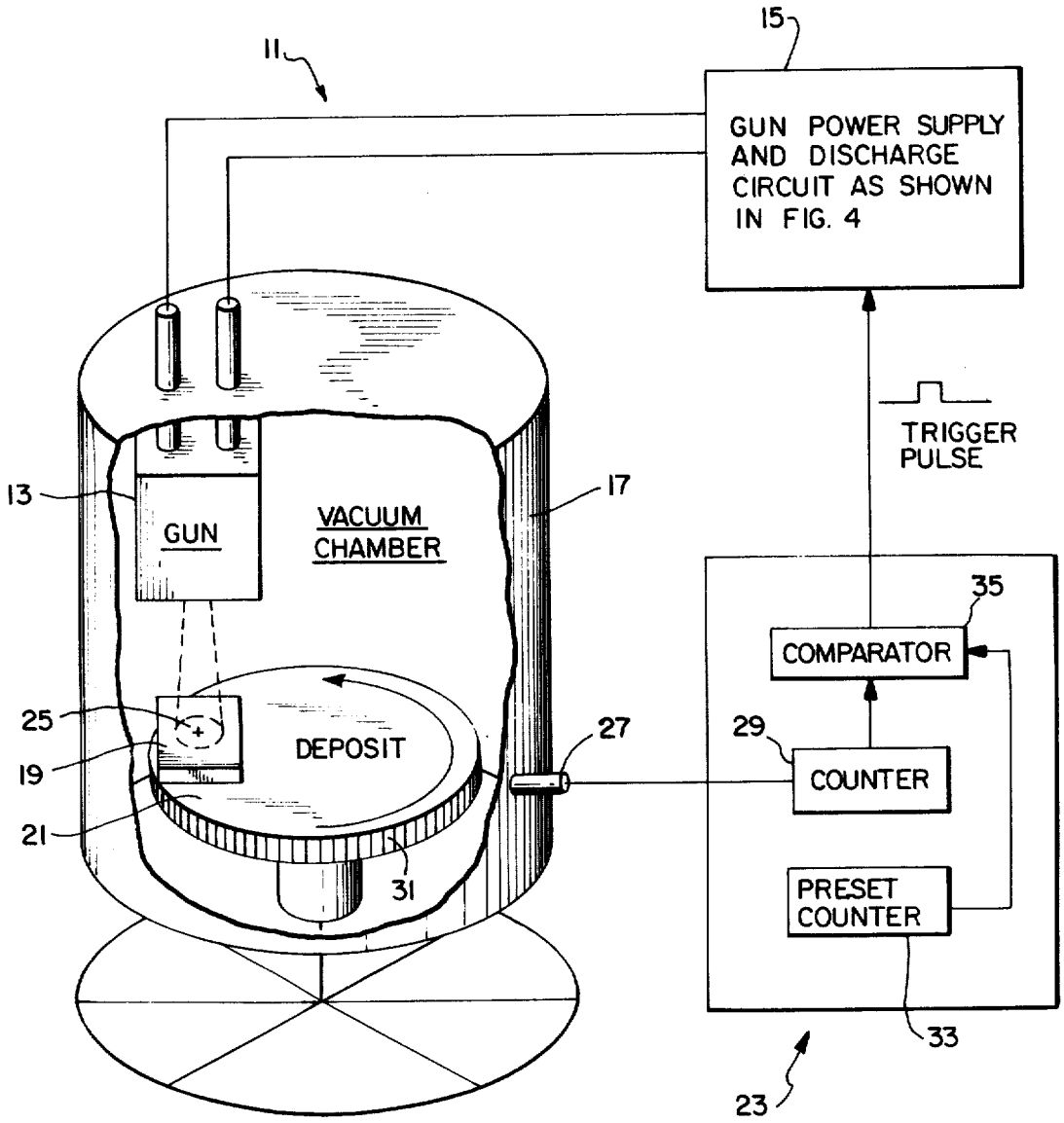
FIG. 1 is a schematic, front elevated view of the apparatus specifically adapted for carrying out the technique of the present invention, the enclosure being shown in section.

FIG. 1 illustrates an assembly, generally indicated at 11, for precisely depositing a metallic slug of spray in a vacuum on a moving surface. The assembly 11 includes a small electromagnetically driven linear mass accelerator or gun 13 and an associated electrical discharge circuit 15. Precise control over the spray slug mass magnitude, the thermal energy added to the mass, and the directed kinetic energy applied to the mass is achieved by a unique relationship between the gun configuration and the discharge circuit characteristics.

The gun 13, which operates at vacuum pressures less than about $10^{-3}$ Torr, is positioned in a vacuum chamber 17 containing a suitable substrate 19 positioned on a movable support 21 such as a turntable. An electronic control system, generally indicated at 23, indexes the motion of a desired deposition point 25 with the triggering of the gun 13 to precisely locate the center of mass of the spray slug on the substrate 19.

The electronic control system 23 takes the form of a shaft-to-digital encoder for automatically indicating preset angular positions of the turntable 21. An optical sensor 27, connected to a counter 29, senses indexing marks 31 as the turntable 21 is rotated in the direction of the arrows shown in FIG. 1. The value of a preset counter 33, which may be a manually settable counter, is compared with the contents of the counter 29 by a comparator 35 which provides a trigger pulse to the discharge circuit 15 to fire gun 13 when the desired deposition point 25 is suitably positioned. Although an optical arrangement is illustrated, it is understood by one skilled in the art that a suitable electromechanical shaft-to-digital encoder or indexed rotational velocity timeline delay generator can alternately be used.

The gun 13 has a discharge time on the order of 10 microseconds with a reloading time of approximately one second to provide a repetition rate on the order of one discharge per second. Although a single substrate is illustrated in FIG. 1, it is understood that a plurality of substrates can be positioned at preset locations on the turntable 21 and separately deposited with a metallic spray mass. Further, the nature of the desired bond between the metallic mass and the substrate can be controlled according to the heat sink characteristics of the surface and the thermal energy added to the mass. Moreover, since the gun 13 accelerates the metallic mass to a relatively high velocity, the deposition process is extremely fast and, therefore, the turntable 21 can be moving at a relatively high velocity transverse to the spray mass without sacrificing accuracy.

Figure 2:
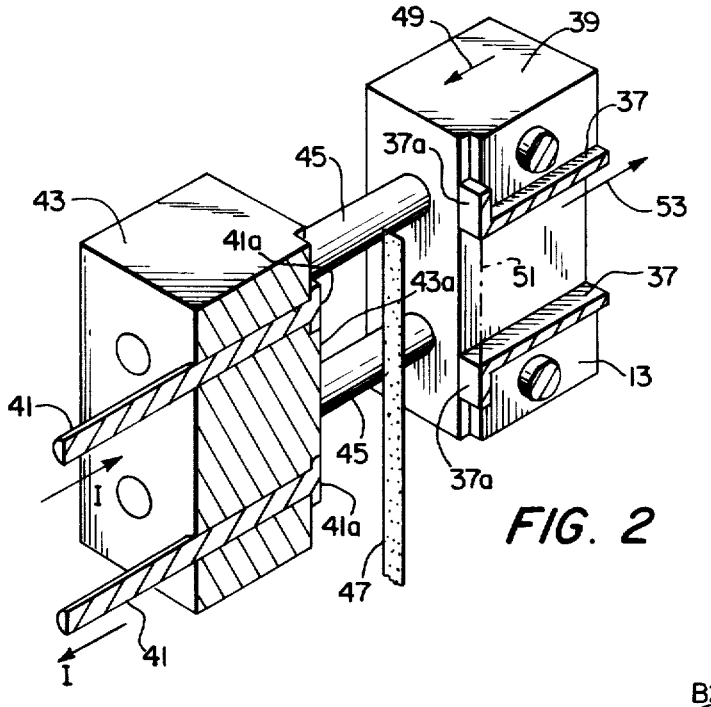
FIG. 2 illustrates half a symmetric gun and foil clamping arrangement of the present invention.

FIG. 2 illustrates a longitudinal sectional view of the gun 13 which, in its simplest form, includes a pair of parallel rail electrodes 37 contained in a dielectric structure 39 which surrounds all but the inner facing surfaces of the rail electrodes 37. The dielectric structure 39 prevents erosion as well as ablation of the electrodes 37 during operation of the gun. The dielectric structure 39 is preferably made from a ceramic material, such as a machinable glass ceramic, and plastic bolts and nuts, such as nylon, can be used for fastening to provide the desired yield properties against the brittle ceramic support structure. A pair of power input electrodes 41, contained in a suitable dielectric structure 43, connect the rail electrodes 37 to the discharge circuit 15. The gun configuration utilizing the electrodes 41 may be termed the long parallel electrode configuration inasmuch as electrodes 41 serve to provide acceleration forces similar to that of rail electrodes 37. The dielectric structure 43 is connected to the gun 13 by pairs of rods 45 on which the dielectric structure 43 is slidable. The structure is symmetric about the cut plane shown in FIG. 2.

In order to load the gun 13, the rail electrodes are positioned as illustrated in FIG. 2, and a thin metallic foil strip 47, having a pre-cut width corresponding to that of the rail electrodes 37, is fed into the gun breach. By moving the rail electrodes 37 in the direction of arrow 49, the foil strip 47 is securely clamped between electrode faces 41*a* of the input power electrodes 41 and faces 37*a* of the rail electrodes 37 so that a forward facing surface 43*a* of the dielectric structure 43 backs the foil strip 47. When a discharge current I is passed through the foil strip 47, a predetermined foil mass 51 is cut from strip 47 and uniformly accelerated along the electrodes 37 in the direction of arrow 53 due to the interaction between the current flowing through the foil mass 51 and a magnetic field resulting from current flow through the electrodes 41 and electrodes 37. The length of electrodes 41 is much greater than their separation so that the magnetic force on the foil mass 51 is essentially constant during acceleration for this gun configuration.

Figure 3A:
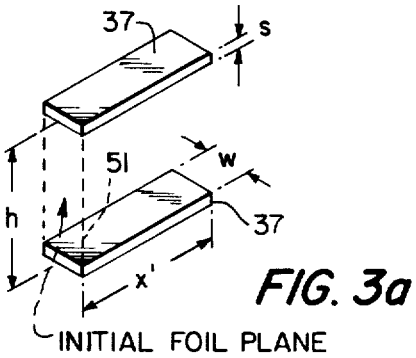

FIG. 3*a* illustrates the initial position of the foil mass 51 with respect to a pair of typical rail electrodes 37. The electrodes are dimensioned to cut out a foil area corresponding to the desired foil mass 51 for a given initial foil thickness and composition. Additionally, the electrodes 37 are dimensioned to provide a large inductance per unit length L' since the accelerating force on the molten foil mass is directly proportional to L'. Using the dimensional symbols shown in FIG. 3*a*:

$$L' = 0.004\left[\ln\left(\frac{h}{w+s}\right) + 1.5\right] \quad (1)$$

in units of microhenries per centimeter. Typically, the operating values of L' are on the order of 0.01 μh/cm.

Figure 3B:
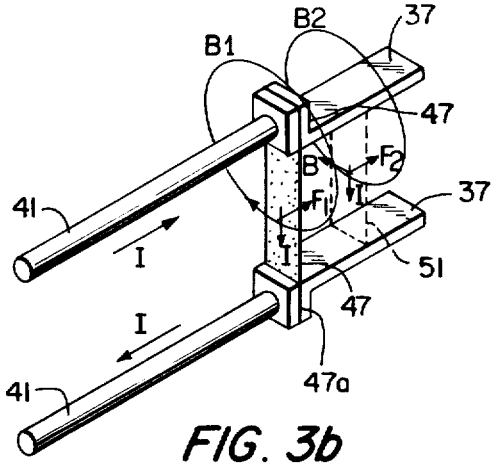

The discharge process of the gun 13 is best understood with reference to FIG. 3*b*, which is a similar view of the gun as in FIG. 2 but without the ceramic housing. Since the foil ends 37*a* and 41*a* have a large current cross-section, and therefore a low resistance, the foil ends 47*a* undergo little heating when passing the discharge current I and remain as a solid. On the other hand, the non-clamped portions of the foil strip 47, hereinafter termed the foil mass 51, has a small current cross-section so that the discharge current I quickly heats and melts the foil mass 51. Initially, a first magnetic field B1, produced by the current flow through the input power electrodes 41, interacts with the foil mass 51 which conducts current I resulting in a force $F_1$ which accelerates the foil mass 51 along the electrodes 37. Once the foil mass begins to move the magnetic field B2, resulting from current flow through the rail electrodes 37, extends beyond the field B1 and continues to accelerate the foil mass 51 in the direction of force F2. Although the magnetic field lines are shown for only one rail electrode, it is understood that they exist symmetrically for both electrodes 37.

Figure 3C:
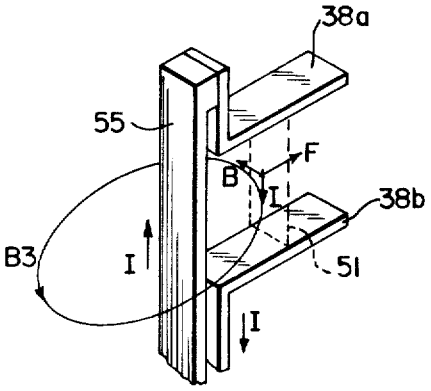

Another embodiment of the gun 13 is illustrated in FIG. 3*c* wherein a backstrap electrode 55 is incorporated behind the foil mass 51, and the long electrodes 41 of FIG. 3*b* are not utilized. This configuration may be termed the short parallel electrode configuration. The backstrap electrode 55 provides a magnetic field B3 which produces an initial accelerating force F at the beginning of the discharge process, which replaces the accelerating force provided by the magnetic field B1, shown in FIG. 3*b*. The embodiment of FIG. 3*c* is most advantageous when the length of the rail electrodes is the same size as or smaller than their separation. The intersection of the backstrap electrode 55 and a rail electrode 38*a* is extended beyond the initial foil clamping plane in order to avoid strong local asymmetry in the accelerating magnetic field. The series circuit includes the backstrap electrode 55, rail electrode 38*a*, foil mass 51 and rail electrode 38*b* connected to discharge circuit 15.

Figure 3D:
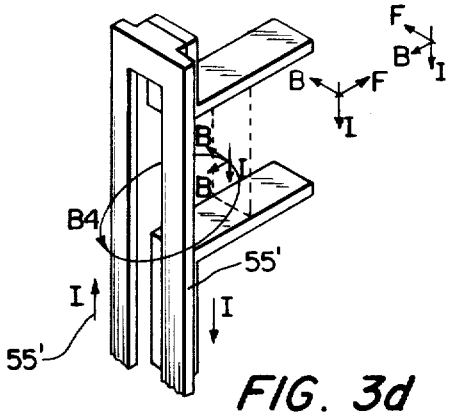

An alternate embodiment of the backstrap electrode 55 is illustrated in FIG. 3*d* wherein a backstrap electrode 55' is symmetrically split about the initial foil position to provide electrode strips 55*a* and 55*b*. The effect of electrode strips 55*a* and 55*b* is to add small axial magnetic field components on each side which tend to focus the foil mass 51 inwardly, but with negligible effect on the acceleration process, and reduces slightly the intensity of the initial accelerating force. The split backstrap electrode is used primarily for structural convenience to allow a thicker dielectric layer behind the foil. The backstrap electrodes 55*a* and 55*b* need not be rectangular, as shown, but may also be rounded.

In the embodiments of FIGS. 3*b*, 3*c*, and 3*d*, the length and spacing of the rail electrodes is the same although such may not necessarily be the case. In the illustrated embodiment, the ratio of the rail electrode length to their spacing is approximately one.

The discharge circuit 15 utilized to drive the deposit gun 13 is best illustrated with reference to FIG. 4. A high voltage power supply 57 is utilized to charge a storage capacitor C to an initial voltage V through a relatively low current charging switch S1° which is opened after the capacitor is charged. The capacitor C is connected to the gun 13 through a discharge switch S2 and external circuit inductance L, a resistance R, and an arc diverter switch S3. Both switches S2 and S3 are fast operating and capable of passing currents on the order of several tens of kiloamperes. High current ignitrons, spark gap devices and the like can be used. Switch S2 is actuated after charging of the capacitor C. Switch S3 is effective to terminate the current discharge through the gun by providing a shunt, low impedance discharge path to ground and is actuated prior to current reversal, preferably shortly prior to the first zero crossing of the current. The circuit of FIG. 4 produces an underdamped bipolar discharge current as shown, for example, in FIG. 5. It is possible, however, to terminate the discharge prior to the normal zero crossing of the current without large loss in exit velocity since, typically, approximately half the foil mass acceleration occurs during the first quarter of the discharge current cycle.

The frequency of the discharge current I is determined by the components of the discharge circuit 15. In accordance with one aspect of the invention, a time delay generator 59 is activated concurrently with the gun discharge and, after a predetermined time delay, is effective to activate the arc diverter switch S3 to ensure that current flow is cut off slightly before the end of the first half-cycle of oscillation. Time delay generator 59 is thus connected to switch S2 to receive part of the discharge voltage to initiate the timing mechanism within the delay generator. The time delay generator, as for example, manufactured by Datapulse may also utilize an amplifying circuit to increasing the firing signal to the switch S3 (ignitron) to ensure reliable firing. The arc diverter switch S3 diverts current flow directly to ground through a suitable high current resistor such as a copper sulfate solution. This procedure prevents current reversal and also inhibits arcing from the rail electrode 37 through the foil mass 51 to the substrate 19. Termination of the current at or near the first zero crossing of the current cycle ensures that current is never conducted through the foil mass in the plasma state. On exiting from the gun, the superheated foil mass is allowed to freely thermally expand in the absence of a dominant pinch field in relation to the forces of thermal expansion.

The use of a separate switch S3 for providing a shunt discharge path is desirable to prevent arcing of switch S2 which would occur if switch S2 alone were utilized to break the current discharge path through the foil mass. Also, high current switches can usually be closed faster than they can be opened. For operation at a low current, it may be possible to utilize switch S2 to both establish and terminate the discharge current through the foil mass.

In accordance with principles of the invention, the mass gun and associated discharge circuit components are uniquely sized to each other according to basic relationships. The gun foil effectively acts as a resistance, R(t) in series with the circuit external resistance R, both part of a series RLC circuit. The circuit components are selected such that the external inductance L and resistance R are larger than the gun inductance L(t) and resistance R(t) respectively. These conditions may be stated as follows:

$$L >> L(t) \tag{2}$$

$$\frac{1}{\{[L + L(t)]C\}^{\frac{1}{2}}} >> \frac{R + R(t)}{2[L + L(t)]} - \frac{1}{(LC)^{\frac{1}{2}}} >> \frac{R}{2L} \tag{3}$$

When the circuit capacitor C is charged to an initial level $q_o$ with potential $V_o$, the instantaneous capacitor charge following circuit closure at the time t=0 is given in MKS units by $$q = q_o e^{\frac{-Rt}{2L}}\left(\cos\omega t + \frac{R}{2\omega L}\sin\omega t\right). \tag{4}$$

The instantaneous current I is given by $$I = dq/dt.$$

With the circuit components sized relative to one another as stated in equations (2) and (3) above, and with $$\omega \doteq \frac{1}{(LC)^{\frac{1}{2}}} \tag{5}$$

the instantaneous current is given by $$I = -q_o\,\omega e^{\frac{-Rt}{2L}}\sin\omega t. \tag{6}$$

A graph of the instantaneous current is shown in FIG. 5 for two half cycles. The current amplitude record of FIG. 5 is an experimentally determined curve utilizing a rail electrode having a length long in relation to the rail separation (X/Y ~ 5 in FIG. 6). The curve is a diagnostic means for measuring the foil mass electrical resistance from the exponential decay envelope to demonstrate dominance of the magnetic pinch pressure over the thermal expansion pressure (i.e. equation (19) below). The electrical resistance of the foil mass increases by orders of magnitude when changing phase from solid to liquid to vapor, and the effect on current amplitude is easily measured. The resistance R is quantitatively obtained from the exponential decay $$e^{\frac{-Rt}{2L}}$$

after evaluating L from the period of oscillation in the relation of equation (5) using C which is known. If R is too large as compared with the value of R as a solid, then the pinch field is not stronger than the thermal expansion pressure, and either the circuit parameters must be adjusted (increase current, I or decrease period of oscillation) or the mass constants must be adjusted (essentially decrease thickness), assuming, of course, a fixed gun geometry.

For short times and small foil resistance, the current is most conveniently expressed as $$I = I_o \sin\omega t,\ I_o = \omega q_o = V_o (C/L)^{\frac{1}{2}} \tag{7}$$

The force, F, on the conducting foil mass, m, in the long parallel electrode case is given by $$F = \tfrac{1}{2}L' I_o^2 \sin^2\omega t. \tag{8}$$

where L' is the gun inductance per unit length in henries/meter. Since $$F = m\frac{dv}{dt},$$

the force expression can be integrated once to give the foil mass velocity $$V = \frac{L'I_o^2}{4m\omega}\left[\omega t - \frac{1}{2}\sin 2\omega t\right] \tag{9}$$

and integrated again to give the axial displacement of the foil mass $$X = \frac{L'I_o^2}{8m}\left[t^2 + \frac{1}{2\omega^2}(\cos 2\omega t - 1)\right] \tag{10}$$

In accordance with the invention, the current in the gun is deliberately cut off at the end of the first half cycle of oscillation. The foil mass thus undergoes all of its acceleration in time t' given by:

$$t' = \pi(LC)^{\frac{1}{2}}. \tag{11}$$

The gun length, X', is equal to X when I=I'. Using the above general expression for the long parallel electrode case, $$X' = \frac{L'}{8m}(\pi C V_o)^2 \quad (12)$$

and the mass velocity v' is given by $$V' = \left(\frac{X'L'C}{2mL}\right)^{\frac{1}{2}} V_o \quad (13)$$

The above expression sets forth the relationship between the terminal velocity of the foil mass 51 and the gun configuration and discharge circuit parameters. The equation for the magnetic force on the mass could have been written $$F = \frac{\mu_0 K}{2\pi} I_o^2 \sin^2 \omega t \quad (14)$$

where the inductance per unit length, L', is equal to $$L' = \frac{\mu_0 K}{\pi}, \quad (15)$$

K is a numerical geometry factor indicative of local magnetic field strength. In the long parallel electrode case, L' is constant and has a value of approximately $1\times10^{-6}$ henry/meter as evaluated using equation (1) above. In that case K has a constant value of about 2.5, as shown by curve 2 of FIG. 7.

When the backstrap electrode is utilized with a short parallel electrode gun configuration, K is not constant but is a function of the local axial position of the foil mass. The geometry for such a configuration is shown in FIG. 6.

$$K = \ln\frac{(X - X_o) + [(X - X_o)^2 + Y_o^2]^{\frac{1}{2}}}{(X - X_o) + [(X - X_o)^2 + (Y - Y_o)^2]^{\frac{1}{2}}} + \ln\frac{(Y - Y_o)}{Y_o} + \frac{(X^2 + Y^2)^{\frac{1}{2}}}{X} - 1$$

The first two terms are from the short parallel rail electrodes 38 and the last two terms are from the backstrap electrode 55. Integration to obtain the equations of motion proceeds as above but now K is a function of foil mass position x which is, in turn, a function of t. Integration is most easily accomplished using computerized numerical integration.

The general relationship between the two embodiments without the backstrap electrode (FIG. 3*b*) and those with the backstrap electrode (FIGS. 3*c* and 3*d*) is apparent from examining the curves of FIG. 7 for K plotted as a ratio, X/Y, of axial displacement of the foil mass X to electrode center separation Y. Curve 1 illustrates the value of K, and consequently the accelerating force as per equation (14), using the short parallel electrode configuration of FIGS. 3*c* and 3*d*. Curve 2 illustrates K for the long parallel electrode configuration of FIGS. 2 and 3*b*. Curve 1 is seen to be the sum of a short parallel rail component (curve 3) and a pure backstrap component (curve 4). The backstrap is seen to contribute greatly to the initial foil mass acceleration, and the short rail contribution (curve 3) matches the long rail contribution (curve 2) at values X/Y ~ 1.4. Typically, gun length to separation ratios have a value close to one. For guns of this size the average value of K for the backstrap plus short parallel electrode case (curve 1) is about twice the value for the long parallel electrode case (curve 2). Consequently, it is apparent that a given foil mass will have approximately twice the exit velocity from the gun with back electrode than from the gun with long parallel electrodes for the same discharge current history. It is apparent that there is an operational choice between the two gun design configurations in terms of greater or less foil resistence heating for a given mass exit velocity. For example, it may be desirable to control the amount of heating of the foil mass, and between the two geometries represented by curves 1 and 2, curve 1 permits the same exit velocity for less heating, i.e., heating goes as $I^2$.

The current magnitude and time variation of the discharge current I is matched to the mass and dimensional cross-section of the foil strip 47 to ensure that current flow through the foil strip 47 creates a self-induced compressive magnetic pinch pressure greater than the vapor pressure of the foil mass 51 during heating. This preserves a positive resistivity verses temperature characteristic to ensure uniform current distribution and, therefore, all parts of the foil mass experience the same acceleration history during discharge.

Thermal expansion of the heated foil may be treated as if it were a dense gas. By kinetic theory, the pressure of a hot droplet spray, $P_{th}$, is, in units of atmospheres $$P_{th} = \tfrac{1}{3}\rho V_{th}^2 \times 10^{-6} \quad (16)$$

where $\rho$ is the mass density and $V_{th}$ is the measured thermal expansion velocity in cm/sec. To assure adequate pinch, $P_{th}$ is evaluated using the mass density in the normal solid state and the measured maximum thermal spread velocity. $V_{th}$ is typically about an order of magnitude smaller at the gun exit than a vapor at the same temperature.

The instantaneous magnetic pinch pressure, $P_{mag}$ is, in units of atmospheres $$P_{mag} = \frac{B^2}{8\pi} \times 10^{-6}. \quad (17)$$

B is directly proportional to the instantaneous value of current I and inversely proportional to distance distance from the center of the current cross-section, r.

$$B = \frac{\mu_0 I^2}{2\pi r} \times 10^4 \text{ gauss} \quad (18)$$

The expression is exact for a circular current cross-section with circular magnetic field lines that wrap around the conductor like an elastic sleeve. In the rectangular current cross-section case the equivalent circular cross-section hydraulic radius is used in place of the smaller foil half thickness for r. The foil hydraulic radius is equal to the ratio of twice the foil cross-sectional area divided by the cross-section perimeter. By combining the above expressions it is possible to calculate the minimum instantaneous value of current $I_{min}$ for which $$P_{mag} \geqq P_{th} \quad (19)$$

Now, the curent reaches the value $I_{min}$ according to its sinusoidal history in time. During this time interval the foil undergoes resistive heating of an amount Q, in joules, given by $$Q = \frac{I_o^2}{2} \overline{R} \left( 1 - \frac{t'}{2\pi t} \sin \frac{2\pi t}{t'} \right) t \tag{20}$$

where $\overline{R}$ is the average foil resistance in ohms, and t' is the current half cycle time. The value of $\overline{R}$ is given by $$\overline{R} = \frac{\overline{\rho}\, l}{A} \tag{21}$$

where $\overline{\rho}$ is the average foil resistivity over the temperature range, l the foil length between electrodes and A the foil rectangular cross-sectional area. The resistive heating raises the temperature of the foil an amount ΔT according to $$\Delta T = Q/\overline{C}_p m \tag{22}$$

where ΔT is the temperature change, m the foil mass and $\overline{C}_p$ the average specific heat over ΔT. A further increment in Q is absorbed in change of phase at constant temperature.

By knowing the physical thermal properties of the foil material, the amount of energy, Q, required to melt it is easily calculated. This value is then used in the heating relation of equation 20 to solve for the time $t_{min}$ required for current to create this amount of heat in the foil. At this time the foil is free to move. By ensuring that the value of the discharge current I at $t_{min}$ is greater than the value $I_{min}$, the magnetic pinch pressure will dominate further change in foil physical properties until the foil reaches the end of the gun electrodes and the current falls below the containment value. It is apparent that current discharges of high peak intensity and small period of oscillation are most effective in achieving pinch domination. As long as the pinch pressure is larger than the vapor pressure of the continually heated foil mass, vaporization (normally accompanied by boiling) is suppressed and the foil mass behaves substantially as a solid attaining temperatures many times greater than observed at atmospheric pressure.

The utilization of the gun may be illustrated in reference to FIGS. 8 and 9. Following acceleration the foil mass 51 forms into a thin cloud of tiny droplets of substantially uniform size. As the droplet cloud exits the gun 13, the droplet vapor pressure far exceeds the background vacuum pressure, and the droplet cloud undergoes very fast decompression as illustrated by FIG. 8. By matching the spacing between the end of the gun 13 and the substrate 19, on which the foil mass 51 is to be deposited, to the instantaneous state of the mass following decompression, a continuous range of deposition conditions are possible from a predominantly uniform droplet spray pulse of relatively narrow lateral dimensions to a completely vaporized pulse of substantially larger lateral dimensions. The foil mass 51 expands at a substantially constant velocity upon leaving the gun 13, and thus as illustrated in FIG. 9, the foil mass 51 may be deposited on the substrate 19 with a substantially uniform shoulder or border.

Referring to FIG. 10, another embodiment of the present invention is illustrated. A movably mounted deposition gun 61 has an automatic foil feed mechanism generally indicated at 63. An electric motor 65 is operatively associated with a continuous feed belt 67 having pegs or projections 69 for engaging prepunched holes through a foil strip 71 stored on a foil supply spool 73. The strip 71 and belt 67 are better illustrated in FIG. 11. The rectangular opening within belt 67 corresponds to the rail width and spacing, e.g., parameters w and h of comparable FIG. 3a. In order to load the gun 61, an end piece 75 is moved in the direction of arrow 77 and the electric motor 65 is driven in the direction of arrow 79 to feed the foil strip 71 from the foil supply spool 73 in a downward direction between rail electrodes 81 and backstrap electrode 83. Thereafter, the end piece 75 is reclamped and a discharge current I is conveyed from the discharge circuit 13 (not shown) through a clamped coaxial cable 85 to discharge the gun 61. The curved ends of rail electrodes 81 have slots or grooves therein to permit clearance of the projections 69. The vertical positioning of the gun 61 is achieved by a pole 85 having projections or cogs 87 adapted to engage gears 89 connected to a reversible electric motor 91 as well as a revolution counter 93. Additionally, a detachable counterweight 95 can be included.

A set of parameter values was developed as follows. Aluminum foil having a thickness of 0.0005 inches was fed between the rail electrodes. Each rail electrode was 0.2 cm by 0.7 cm by 2.40 cm and separated by 2.1 cm to give an inductance per unit length of one microhenry per meter and a magnitude for the foil mass of 5 milligrams. The storage capacitor C had a capacitance of 28 microfarads, and the external circuit inductance L was selected to be 3 microhenries to provide an acceleration time of approximately 30 microseconds, which was equal to the first half cycle of discharge oscillation.

In operation, the capacitor was initially charged to a voltage $V_o$ of about 11,140 volts and the discharge current I had a peak current amplitude of 34,000 amps providing a mass exit velocity of 1,670 meters per second. When the deposition surface 19 was moved at one-half the mass exit velocity, the mass deposit outline 5 cm from the gun 13 was roughly elliptical with axes approximately equal to 3.3 cm by 3.8 cm. The deposition thickness was on the order of 0.0001 inches at its center. With the timing accuracy of one microsecond, the center of mass of the foil 51 could be located within one millimeter of the predetermined deposition point 25.

While the invention has been particularly shown and described with reference to preferred embodiments thereof, it will be understood by those skilled in the art that various alterations in form and detail will be made therein without departing from the spirit and scope of the invention. In particular, it is envisioned that the confinement condition represented by equation (19) could be obtained with a high frequency bipolar discharge pulse which would maintain the solid nature of the foil mass even though the current passes through zero. Thus, as long as the time period during which equation (19) is not satisfied is small, it may be possible to maintain or reestablish the solid mass confinement of the foil and either prevent plasma formation altogether or minimize its duration so that the mass predominantly behaves as a solid satisfying equation (19).

What is claimed is:

1. A vacuum deposit apparatus comprising:

(a) a gun having first and second rail electrodes, and operable within a vacuum chamber (b) means for supporting a metallic mass in an initial position adjacent said electrodes, (c) an electrical discharge circuit including:

(1) capacitor means for storing a charge, (2) circuit elements in circuit with said capacitor means, said rail electrodes and said mass for providing a bipolar discharge current, at least a portion of said discharge current passing through said mass for accelerating said mass adjacent said electrodes, and (3) switch means operative in a predetermined state for preventing said discharge current from passing through said mass, (d) a time delay circuit, coupled to said switch means, for operating said switch means in said predetermined state prior to a change in polarity of said bipolar discharge current, and (e) said circuit elements and time delay circuit cooperate to control the magnitude and time duration of said discharge current to accelerate said mass along said rails without vaporization of said mass.

2. A vacuum deposit apparatus as recited in claim 1 wherein said bipolar discharge current is an underdamped discharge current.

3. A vacuum deposit apparatus as recited in claim 1 or 2 wherein said time delay circuit operates said switch means after a predetermined time interval sufficient to permit travel of said mass proximate the end of said rail electrodes.

4. A vacuum deposit apparatus as recited in claim 3 wherein said discharge current produces a magnetic pinch pressure on said mass larger than the thermal expansion pressure of said mass for maintaining said mass in a solid, non-vapor state during acceleration.

5. A vacuum deposit apparatus as recited in claim 4 wherein said rail electrodes are positioned parallel to one another and said mass is accelerated in a region between said electrodes.

6. A vacuum deposit apparatus as recited in claim 3, wherein said rails have a length determined by said predetermined time interval for providing a desired terminal exit velocity of said mass.

7. A vacuum deposit apparatus as recited in claim 6, wherein said bipolar discharge current is a sinusoidal current and said time delay circuit is operative for terminating said discharge current through said rails and mass at approximately the end of one-half cycle of said sinusoidal current.

8. A vacuum deposit apparatus as recited in claim 2, wherein one of said circuit elements comprises an inductor having an inductive reactance larger than the internal inductive reactance of said rail electrodes and mass.

9. A vacuum deposit apparatus as recited in claim 8, wherein said inductor has an inductive reactance of about two orders of magnitude larger than said rail and mass internal inductive reactance.

10. A vacuum deposit apparatus as recited in claim 1, further comprising a switch, separate from said switch means, for discharging said capacitor and initiating said discharge current and wherein the length of said rail electrodes is a function of the mass of said metallic mass, the inductance per unit length of said rail electrodes, the capacitance of said capacitor, and the initial voltage established by the initial charge on said capacitor immediately prior to operation of said separate switch.

11. A vacuum deposit apparatus as recited in claim 1, further comprising:

(a) a backstrap electrode, (b) means for supporting said backstrap electrode spaced from and parallel to the initial position of said mass, and (c) means for connecting said backstrap electrode in series with one of said rail electrodes, said mass and another of said rail electrodes whereby discharge current in said backstrap electrode runs opposite to said discharge current in said mass to produce mutual repulsion for augmenting acceleration of said mass.

12. A vacuum deposit apparatus as recited in claim 11, wherein said backstrap electrode comprises a first and second strip spaced from and parallel to one another and symmetricaly positioned adjacent the initial position of said mass whereby said mass is focused during initial acceleration of said mass between said electrodes.

13. A vacuum deposit apparatus as recited in claim 1, 11 or 12, wherein said mass comprises a metallic foil and said means for supporting said mass in said initial position comprises:

(a) a flexible support belt, (b) means for securing said foil to said support belt, (c) means for automatically feeding a portion of said support belt and foil to the initial position adjacent said rail electrodes, and (d) means for automatically feeding said portion of said belt away from said initial position after firing of said gun and for simultaneously feeding another portion of said support belt and foil to said initial position whereby said gun may be automatically loaded and reloaded with metallic foil mass.

14. A vacuum deposit apparatus as recited in claim 13, wherein said means for securing comprises projections extending from a surface of said support belt for registration through apertures in said foil.

15. A vacuum deposit apparatus as recited in claim 14, further comprising a supply reel onto which said foil is wrapped, said means for automatically feeding comprising means for rotating said supply reel.

16. A high velocity metallic spray vacuum deposit device comprising:

(a) a vacuum chamber, (b) an electromagnetically driven linear mass accelerator gun for heating a metallic mass and accelerating the mass to a desired terminal velocity, said gun being positioned within said vacuum chamber, (c) a discharge circuit connected to said gun for supplying a cyclic discharge current having a predetermined time variation and magnitude, said discharge current passing through said mass for accelerating said mass, said discharge circuit including means for preventing said discharge current from passing through said mass at a time prior or equal to the zero crossing of said current, said discharge current producing a magnetic pinch pressure on said mass larger than the thermal expansion pressure of said mass for maintaining said mass in a solid, non-vapor state during acceleration within said gun, (d) means for triggering said discharge circuit for accelerating said mass, (e) a movable support positioned within the vacuum chamber for supporting a substrate having a desired deposition area, and (f) means for coordinating the motion of said support with the triggering of said gun to precisely locate the metallic mass on the desired deposition area of the substrate.

17. A device as recited in claim 16, wherein said gun comprises:

a pair of parallel rail electrodes having a given length, width, spacing distance and inductance per unit length, input power means for connecting said electrodes to said discharge circuit, and means for clamping the metallic mass at an initial loading position between said rail electrodes to pass the discharge current through the mass during the triggering of said gun.

18. A device as recited in claim 17, wherein said gun further includes a backstrap electrode positioned behind and substantially parallel to the initial loading position of the metallic mass for passing a current anti-parallel to the discharge current passing through the mass during the triggering of said gun.

19. A device as recited in claim 18, wherein said backstrap electrode is symmetrically split about the initial mass loading position to provide an axial magnetic field component for focusing said mass inwardly during the initial acceleration of said mass.

20. A device as recited in claim 19, wherein said metallic mass is a thin metallic foil strip having a given thickness, and a width corresponding to the width of said rail electrodes.

21. A device as recited in claim 20, wherein said electrodes are dimensioned to cut out a foil area from the foil strip corresponding to a desired mass of known magnitude for a given initial foil thickness and composition.

22. A device as recited in claim 21, wherein said input power means comprises input power electrodes and the foil strip is clamped between faces of said rail electrodes and said input power electrodes.

23. A device as recited in claim 22, wherein said rail electrodes are movably mounted to said input electrodes to create a gun breach into which the foil strip can be fed.

24. A device as recited in claim 16 or 23, wherein said discharge circuit comprises:

a capacitor, means for charging said capacitor to a given voltage, a circuit inductance substantially greater than the gun inductance, a circuit resistance predominantly that of the foil mass, means for discharging said capacitor through said circuit inductance and said circuit resistance to provide an underdamped oscillating discharge current having a predetermined magnitude and time variation, and said discharge current preventing means includes:

an arc diverter switch for terminating current through said mass, and a time delay generator, activated concurrently with said discharging means for operating said diverter switch prior to or at the end of the first half cycle of discharge current oscillation.

25. A device as recited in claim 24, wherein the mass acceleration given along said rail electrodes is matched to the magnitude of said mass, the discharge circuit capacitance, the discharge circuit inductance, the initial charge on said capacitor and the gun inductance so that the discharge current reaches the end of the first half cycle of oscillation as the mass reaches the end of said rail electrodes with a desired, reproducible mass exit velocity.

26. A device as recited in claim 16, wherein said mass comprises a metallic foil and said device further comprises:

a pair of rail electrodes for accelerating said mass therebetween, means for securing said foil to an initial position adjacent said rail electrodes, a flexible support belt, means for securing said foil to said support belt, means for automatically feeding a portion of said support belt and foil to the initial position adjacent said rail electrodes, and means for automatically feeding said portions of said belt away from said initial position after firing of said gun and for simultaneously feeding another portion of said support belt and foil to said initial position whereby said device may be automatically loaded and reloaded with said metallic foil mass.

27. A device as recited in claim 26, wherein said means for securing comprises projections extending from a surface of said support belt for registration through apertures in said foil.

28. A device as recited in claim 27, further comprising a supply reel onto which said foil is wrapped, said means for automatically feeding comprising means for rotating said supply reel.

* * * * *